US008783383B2

(12) United States Patent
Senules

(10) Patent No.: US 8,783,383 B2
(45) Date of Patent: Jul. 22, 2014

(54) BOREHOLE IMPACT ROCK BREAKER

(75) Inventor: Jeffrey S. Senules, Beverly Hills, FL (US)

(73) Assignee: Jeffrey S. Senules, Crystal River, FL (US)

( * ) Notice: Subject to any disclaimer, the term of this patent is extended or adjusted under 35 U.S.C. 154(b) by 522 days.

(21) Appl. No.: 13/085,875

(22) Filed: Apr. 13, 2011

(65) Prior Publication Data

US 2011/0253451 A1 Oct. 20, 2011

Related U.S. Application Data

(60) Provisional application No. 61/324,368, filed on Apr. 15, 2010.

(51) Int. Cl.
*E21B 10/36* (2006.01)

(52) U.S. Cl.
USPC ..... 175/293; 175/414; 175/405; 299/22; 299/23

(58) Field of Classification Search
USPC ..... 175/57, 298, 305, 405, 414, 293; 299/22, 23; 166/216; 254/104
See application file for complete search history.

(56) References Cited

U.S. PATENT DOCUMENTS

| | | | | |
|---|---|---|---|---|
| 3,995,906 | A | 12/1976 | Darda | |
| 4,190,293 | A | 2/1980 | Nieder | |
| 4,215,901 | A | 8/1980 | Langfield et al. | |
| 4,571,002 | A | 2/1986 | Akanuma et al. | |
| 6,360,831 | B1 * | 3/2002 | Åkesson et al. | 175/269 |
| 6,948,573 | B2 | 9/2005 | China et al. | |
| 2009/0101377 | A1 | 4/2009 | Robson | |

* cited by examiner

*Primary Examiner* — Yong-Suk (Philip) Ro
(74) *Attorney, Agent, or Firm* — The Webb Law Firm

(57) ABSTRACT

A device used to break rock from within a predrilled borehole through the use of impact pins which strike against the interior sides of a drilled hole. The device is loaded into a drilled hole and then activated by a percussive hammer located above the hole, providing percussive energy to the device which is then transferred to the sidewall of the drilled hole. The device includes an inner piston assembly which includes a driving surface for causing impact pins to strike the interior sidewall of the drilled hole in a rapid percussive manner so as to greatly improve the ability to break and shatter surrounding rock or concrete.

19 Claims, 6 Drawing Sheets

BOREHOLE IMPACT ROCK BREAKER

CROSS-REFERENCE TO RELATED APPLICATIONS

This application claims priority to U.S. Provisional Patent Application No. 61/324,368 filed on Apr. 15, 2010, the entire contents of which are incorporated herein by reference.

BACKGROUND OF THE INVENTION

1. Field of the Invention

This invention relates to a device for use in splitting and breaking rock from inside of a predrilled hole. More specifically, this invention is directed to a borehole impact rock breaker that utilizes impact pins which extend from the device in order to transfer energy from a percussion hammer into a rock formation.

2. Description of Related Art

Existing devices designed to split and break rock from the inside of a predrilled borehole fail to utilize the efficiency and increased breaking ability of a rapidly striking pin. Instead, known in-hole rock splitters apply force to the inside of the borehole by exerting pressure, generally through the use of hydraulics, against a center piston which then spreads out wedges or cheeks which push against the rock formation. Such devices are described in U.S. Pat. No. 4,571,002 and U.S. Pat. No. 3,995,906, the entire contents of which are incorporated by reference herein. Newton's second law of motion allows quantitative calculation of dynamics, with force defined as mass (weight)×acceleration (change in velocity). Known in-hole rock splitters which use a center piston pressed between spread plates, utilize tremendous pressure/mass to spread plates and wedges. However, these devices do not deliver a high amount of force to the rock because the mass is not complemented with adequate acceleration. Advances in hydraulic and pneumatic percussion hammers have made hammers which can generate tremendous force with hundreds of impacts per second both possible and economical. However, there are no known in-hole rock splitting devices which take advantage of the operation of these percussion hammers.

SUMMARY OF THE INVENTION

Provided is a device used to break rock from within a predrilled borehole. In one embodiment, the device includes an outer sleeve having a first end, a second end and a sidewall extending between the first end and the second end. The device further includes an inner piston assembly slidably housed within the outer sleeve and configured for engagement with a percussive hammer, the inner piston assembly having at least one driving surface. In addition, the device includes at least one impact pin in communication with the driving surface. Movement of the inner piston assembly within the outer sleeve causes the driving surface to force the impact pin to extend from the sidewall of the outer sleeve and strike the inner sidewall of the borehole.

In certain non-limiting embodiments, the device can include multiple impact pins, multiple driving surfaces, or both multiple impact pins and multiple driving surfaces.

Also provided is a method of breaking rock from within a predrilled borehole. The method includes positioning in the borehole the rock breaker device described herein and activating a percussive hammer to cause the impact pins to repeatedly strike the inner sidewall of the borehole.

In one non-limiting embodiment, the method further includes rotating the rock breaker device in order to align the impact pins with a desired section of the borehole.

Also provided is an assembly used to break rock from within a predrilled borehole that includes a percussive hammer connected to the rock breaker device described herein.

DETAILED DESCRIPTION OF THE INVENTION

Figure 2:
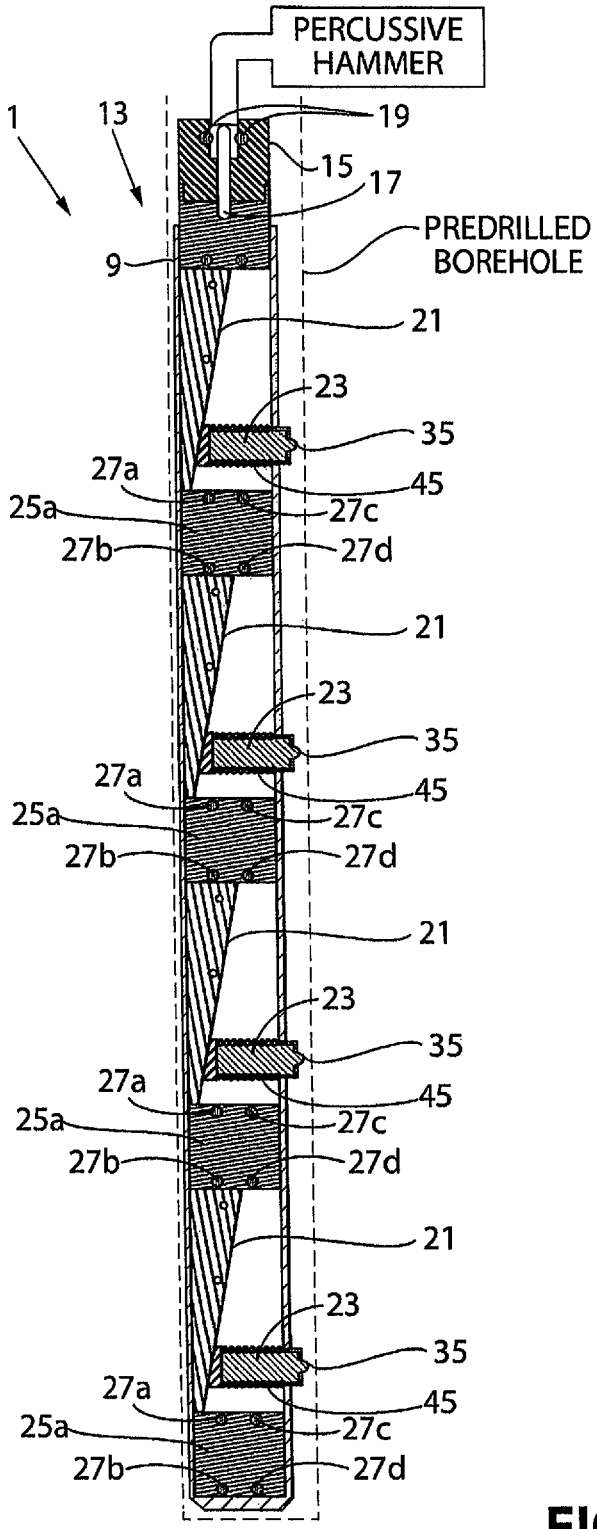
FIG. 2 is a cross-sectional side view of the device of FIG. 1 along line A-A.

As used herein, spatial or directional terms, such as "left," "right," "inner," "outer," "above," "below," "top," "bottom," and the like, relate to the invention as it is shown in FIG. 2. However, it is to be understood that the invention may assume various alternative orientations and, accordingly, such terms are not to be considered as limiting. Further, as used herein, all numbers expressing dimensions, physical characteristics, and the like, used in the specification and claims are to be understood as being modified in all instances by the term "about."

This invention is directed to a device and method used to break rock from within a drilled hole by transferring to the rock impact force from various types of modern and readily available percussive impact hammers that can be attached to this device via an inner piston assembly which propels hardened impact pins against the inner surface of the sidewall of the drilled hole. The device can be very robust and have few moving parts, all of which can be easily replaced. The device is engineered to transfer percussive/impulse mass in excess of 200, such as 700 or 800, impacts per minute to small pins that transfer and concentrate percussive energy against the inner surface of the sidewall of a drilled hole.

Figure 1:
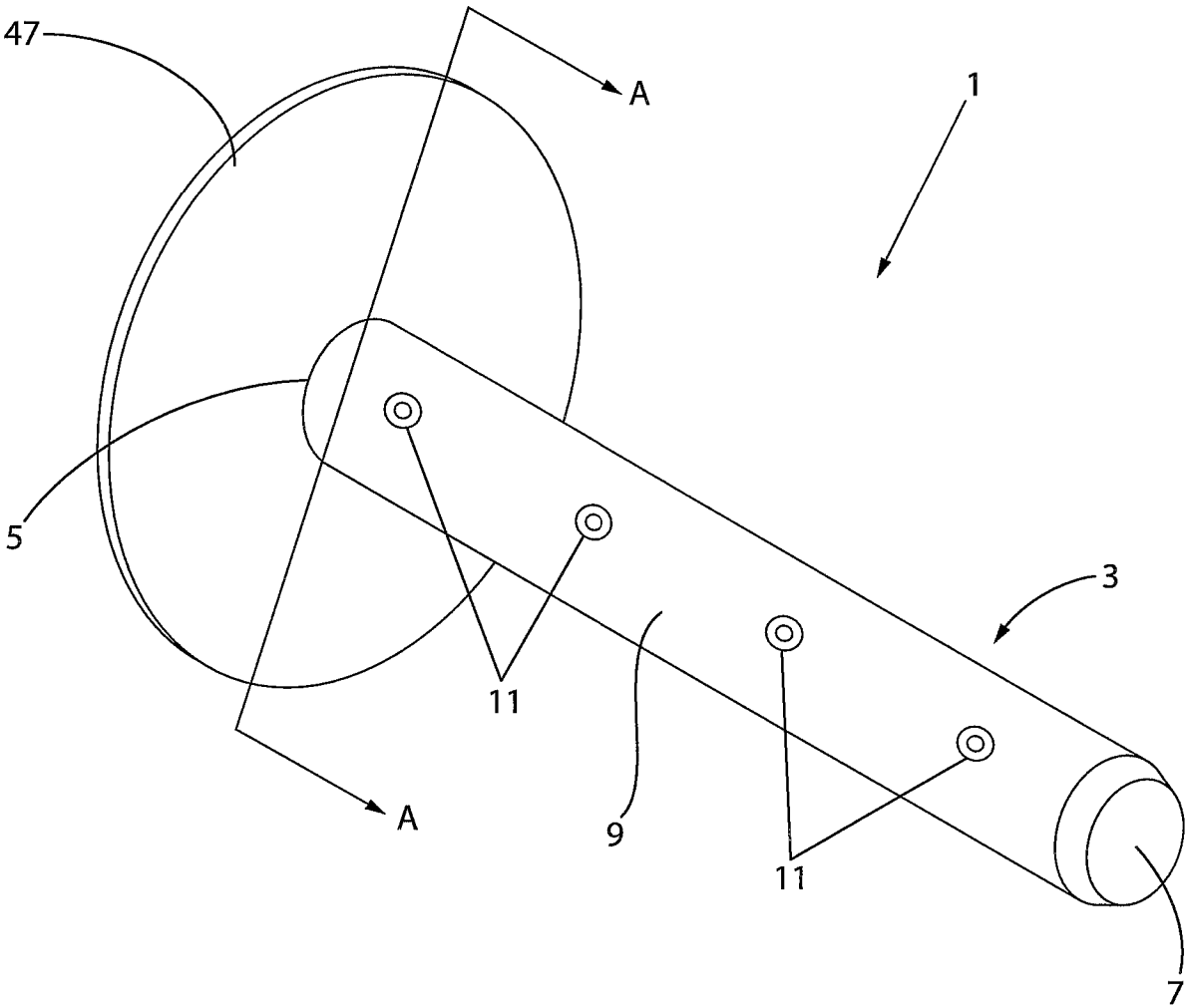
FIG. 1 is a perspective view showing one embodiment of the rock breaker device of the present invention.

Reference is now made to FIG. 1, which shows one non-limiting embodiment of a borehole impact rock breaker 1 according to the present invention. Recent advances in pneumatic- and hydraulic-powered percussive hammers have resulted in improved performance, smaller size, lower operating cost and vastly increased impact force. These types of hammers, often referred to as percussive hammers, impact hammers, or hammer drills, are well known and widely used in the art. Rock breaker 1 is intended to be used as an attachment which can be powered by these types of hammers and which enables these hammers to apply force within a borehole in a more focused manner to break rock.

Rock breaker 1 includes an outer sleeve or spine 3 defined by a first end 5, a second end 7, and a sidewall 9 extending between the first end 5 and the second end 7. Outer sleeve 3 defines an interior space which serves to encase or house other portions of the rock breaker 1. Outer sleeve 3 is preferably cylindrical in shape, though other shapes are envisioned.

Outer sleeve 3 is preferably constructed of a metal material, such as steel. Along the length of sidewall 9 of outer sleeve 3 are disposed one, and preferably a plurality, of holes 11, the significance of which will become apparent later. Holes 11 are preferably aligned with one another in the longitudinal direction along sidewall 9. Rock breaker 1 may be comprised without an outer sleeve 3 depending on the configuration of the remaining elements, and particularly the inner piston assembly 13, though an outer sleeve 3 is preferred.

Rock breaker 1 further includes an inner piston assembly 13. Inner piston assembly 13 is preferably housed within outer sleeve 3. The outer dimension of inner piston assembly 13 is preferably small enough to allow inner piston assembly 13 to be slidable in the longitudinal direction of outer sleeve 3 though large enough so that inner piston assembly 13 maintains a snug fit with the inner surface of the outer sleeve 3 to prevent jostling and rattling of inner piston assembly 13 as it slides about within outer sleeve 3.

Movement of inner piston assembly 13 is effected primarily through the action of a percussive hammer attached to rock breaker 1. More specifically, the percussive hammer can be attached, either directly or indirectly, to inner piston assembly 13 so that the cyclic hammering action of the percussive hammer causes the inner piston assembly 13 to correspondingly slide up and down in the longitudinal direction of the outer sleeve 3. The percussive hammer can engage the inner piston assembly 13 in a variety of ways to enable this coordinated movement. Preferably, the hammer engages the upper end of the inner piston assembly 13 through a connection linkage 15 disposed at the upper end of the inner piston assembly 13. The connection linkage 15 serves to link the hammer with the inner piston assembly 13 and can be considered part of the inner piston assembly 13 in the sense that it will also move in an up and down motion in coordination with the action of the hammer. A preferred embodiment of the connection linkage 15 includes a female groove 17 which accepts the common bit of a percussive hammer along with a pair of driving pins 19 or other appropriate mechanism to secure the bit to the connection linkage 15.

Inner piston assembly 13 can take on various configurations and assemblies. However, a common feature of the envisioned inner piston assembly 13 is a driving surface 21. Driving surface 21 is a surface of the inner piston assembly 13 that, upon movement of the inner piston assembly 13, interacts with an impact pin 23, or multiple impact pins 23, and causes impact pin 23 to move between a retracted position and a position where impact pin 23 can strike the inner surface of the sidewall of the borehole, as discussed further below. In other words, driving surface 21 acts to force the impact pin 23 away from the outer sleeve 3 so that it can strike an inner surface of the sidewall of the borehole.

Figure 4:
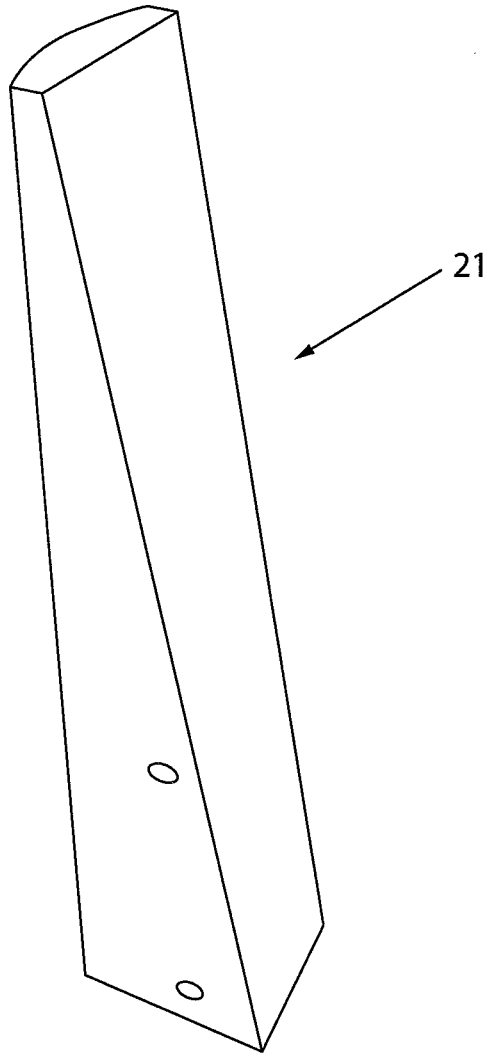
FIG. 4 is a perspective view showing one embodiment of the driving surface of the present invention.

In one non-limiting embodiment, shown in FIG. 4, driving surface 21 is a monolithic member, preferably constructed of metal, and generally in the shape of a wedge, with an angled surface that tapers from one end (i.e., the thick end) to the other (i.e., the thin end). In this arrangement, the impact pin 23 can ride on the driving surface 21 and, as the driving surface 21 travels in the downward direction as shown in FIG. 2, the tapered driving surface 21 steadily forces the impact pin 23 from its retracted position within the outer sleeve 3 to a position where the impact pin 23 extends from the sidewall 9 of the outer sleeve 3. This movement of the impact pin 23 creates a focused striking force which can be transferred to the wall of the borehole.

The above embodiment of the driving surface 21 is not intended to be limited. Another non-limiting shape for driving surface 23 is that of a cone. Driving surface 21 is similarly not limited to a monolithic structure, and it can be in the form of a combination of pieces that are attached or affixed to one another or a combination of separate pieces that interact with one another. An example of the latter is a combination of a first wedge which initiates movement of a second wedge to force the impact pin 23 from its retracted position. Driving surface 21 could also include more than one angled surface, such as two surfaces joined at an obtuse angle or two wedge pieces placed with the thick ends abutting one another, such that the impact pin 23 can both extend and retract in a single pass of driving surface 21. It should be understood that other shapes and configurations of the driving surface 21 can also be utilized without departing from the scope of the invention.

Inner piston assembly 13 can be composed of multiple driving surfaces 21. FIG. 2 shows an embodiment where inner piston assembly 13 includes four driving surfaces 21. In this arrangement, each driving surface 21 is associated with a respective impact pin 23. Including multiple impact pins 23 allows for additional impact points within the borehole, thereby aiding in the weakening and eventual breaking of the rock. In such an arrangement, each driving surface 21 included in the inner piston assembly 13 may be the same or various configurations of driving surfaces 21 may be used within the same rock breaker 1. For instance, certain configurations of the driving surface 21 may promote deeper (or faster) striking of the impact pin 23, and these configurations may be preferred at deeper locations within the borehole. In such a case, the operator can configure the inner piston assembly 13 to include driving surfaces 21 that promote deeper impact near the bottom end of the rock breaker 1 while opting for alternative driving surfaces 21 for use at shallower locations. This ability to customize the rock breaker 1 based on a particular need is simply another one of the advantages of this invention.

Figure 3:
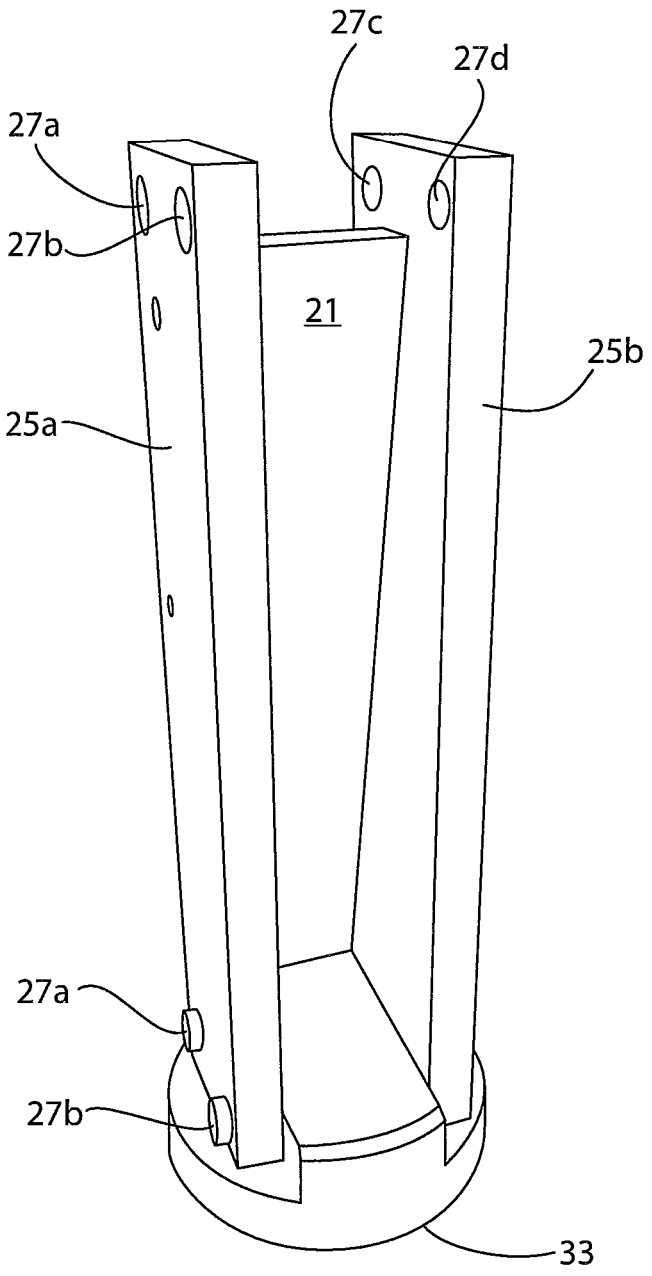
FIG. 3 is a perspective view showing a portion of one embodiment of the inner piston assembly of the device of FIG. 1.
Figure 5:
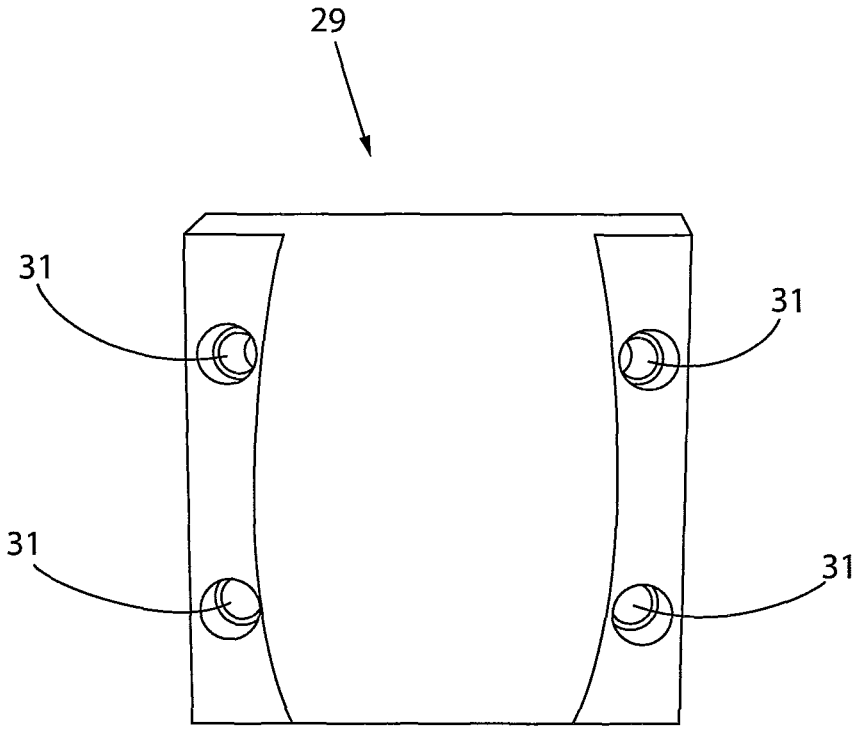
FIG. 5 is a perspective view showing one embodiment of the intermediate linkage of the present invention.

When piston assembly 13 is comprised of multiple driving surfaces 21, it is preferable, though not necessary, that the driving surfaces are either directly or indirectly attached to one another. Such connection promotes the smooth and coordinated movement of the various driving surfaces 21 relative to one another, which itself can promote predictable and potentially coordinated striking of the impact pins 23. In one non-limiting embodiment, shown in FIG. 3, the driving surface 21 is sandwiched between two opposing plates 25*a-b* which hold the driving surface 21 in place. The driving surface 21 can be secured to the plates 25*a-b* through the use of one or more bolts which pass from one plate 25*a*, through the driving surface 21 and then through the other plate 25*b*. Each plate 25*a-b* can also have disposed at one or both ends holes 27*a-d*. These holes 27*a-d* provide a mechanism by which to attach the plates 25*a-b* associated with one driving surface 21 with the corresponding plates 25*a-b* associated with a neighboring driving surface 21 and thereby connect two neighboring driving surfaces 21 with one another. In the embodiment disclosed in FIG. 2, this connection is accomplished by the additional use of an intermediate linkage 29, shown in FIG. 5, which is a substantially disk-like member having holes 31 on either side thereof. The holes 31 can align with the holes 27*a-b* at the ends of the plates 25*a-b* from neighboring driving surfaces 21, thereby attaching two neighboring driving surfaces 21 to one another through the intermediate linkage 29. Such an intermediate linkage 29 has the added advantage that the disk-like portion can have an outer diameter which closely aligns with the inner diameter of the outer sleeve 3 to aid in guiding the inner piston 13 assembly within the outer sleeve 3. Neighboring driving surfaces 21 can, of course, be connected by other mechanisms as well, such as tongue-in-groove type arrangements and the like.

The bottom-most driving surface 21 in the inner piston assembly 13 can have attached to the bottom end thereof a terminating linkage 33. The terminating linkage 33 can act as a stopper or brake which prevents the inner piston assembly 13 from extending beyond the second end 7 of the outer sleeve 3. The terminating linkage 33 can be substantially similar in shape and configuration as intermediate linkage 29, though only one set of plates with holes 31 would be included as the terminating linkage 33 only attaches to a single driving surface 21. In a preferred embodiment, terminating linkage 33 can impact a stopper or cap disposed at the second end 7 of the outer sleeve 3. Connection linkage 15, discussed above, can have a similar shape with plates with holes 31 for connection with a driving surface 21. However, connection linkage 15 should also have a portion which can connect with a percussive hammer, as discussed above. Linkage pieces 15, 29, 33 are preferably composed of metal.

As mentioned above, rock breaker 1 further includes at least one impact pin 23. Impact pin 23 is used to strike the inside sidewall surface of the borehole, and thereby transfer force from the percussive hammer to the sidewall of the borehole. Impact pin 23 is preferably composed of a hard metal material, such as a steel material. Impact pin 23 preferably has a tip 35 disposed at the center of the striking surface. The tip 35 is a slightly raised portion made of a material that is preferably harder than the remainder of the impact pin 23, and may be a carbide material. Tip 35 can further focus the striking force of the impact pin 23 to an even smaller surface area, thereby increasing the striking pressure applied to the borehole sidewall. The end 37 of impact pin 23 opposite the tip 35 can be configured to communicate with, such as by contacting or riding on, driving surface 21. The communication between the end 37 of impact pin 23 and driving surface 21 may be further facilitated by shaping the end 37 to conform to the shape of driving surface 21 or lubricating the end 37. Through this communication between impact pin 23 and driving surface 21, driving surface 21 is capable of applying a force to impact pin 23 which impact pin 23 can thereby transfer to the borehole through a striking action. Impact pins 23 preferably pass through and/or extend from holes 11 in sidewall 9 of outer sleeve 3 when striking the inner surface of the sidewall of the borehole.

In a preferred embodiment, impact pins 23 extend from sidewall 9 in a substantially perpendicular direction relative to the longitudinal direction of the sidewall 9 so that impact pins 23 can strike the inside surface of the borehole in a direction substantially perpendicular to, such as within 20° of or within 10° of, the longitudinal direction of the borehole. However, depending on the formation of the rock material, it may be desirable for impact pins 23, or at least one impact pin 23, to strike the inside surface of the borehole in an angled direction relative to the longitudinal direction of the borehole, such as an upwardly-angled or downwardly-angled direction. In one non-limiting embodiment, such an angled striking action may be accomplished by shaping end 37 of impact pin 23 and/or collar 39 (discussed below) so that driving surface 21 forces impact pin 23 away from outer sleeve 3 at an upward or downward angle relative to the longitudinal direction of the borehole.

Figure 6:
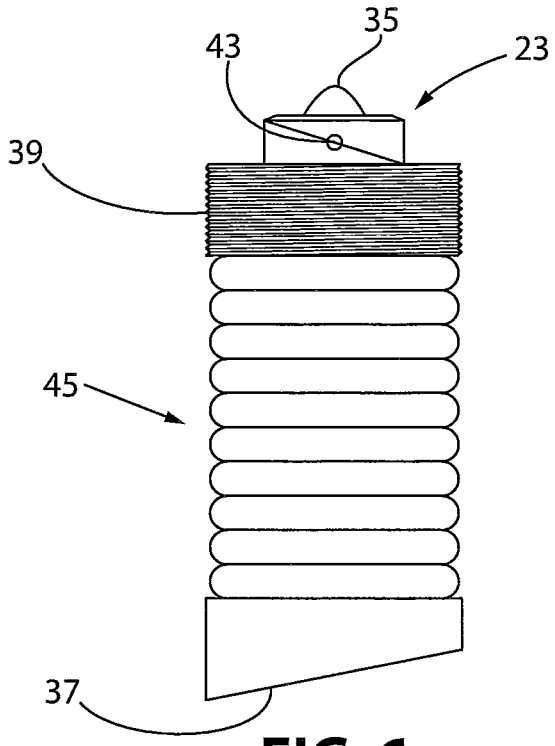
FIG. 6 is an elevation view showing one embodiment of the biasing member and impact pin of the present invention.
Figure 7:
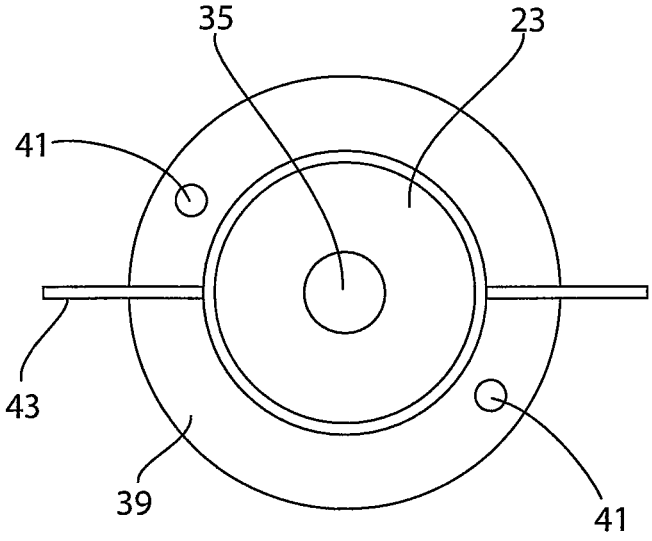
FIG. 7 is a top plan view of the biasing member and impact pin of FIG. 6.

With reference to FIGS. 6-7, impact pin 23 can include a collar 39 that surrounds the impact pin 23 near the tip end of the impact pin 23. The collar 39 can include holes 41 for securing collar 39 to outer sleeve 3. Collar 39 can be aligned with holes 11 in outer sleeve 3 and then secured thereto. Collar 39 can thereby help align impact pin 23 with holes 11 in outer sleeve 3. Collar 39 may also work in conjunction with a holding pin 43 which passes horizontally through impact pin 23 near the tip end to retain a biasing member 45 in the biased position. For instance, with holding pin 43 in place, impact pin 23 cannot retract beyond collar 39 and biasing member 45, which can engage end 37 of impact pin 23, cannot expand, as shown in FIG. 6. The use of a holding pin 43 can facilitate the assembly of the impact pin 23 feature of the rock breaker device 1. Without holding pin 43, the biasing member 45 may naturally expand, making it difficult to fit the impact pin 23 within the space between the driving surface 21 and the inside surface of outer sleeve 3 during assembly.

As mentioned above, a biasing member 45 can be associated with impact pin 23. Biasing member 45 acts to counter the force applied by driving surface 21 and thereby cycle the impact pin 23 back to a biased position after the force being applied by driving surface 21 is removed so that impact pin 23 is positioned to interact with driving surface 21 to strike the rock again. Biasing member 45 is preferably contained in the space between driving surface 21 and the inner surface of outer sleeve 3. The biasing force applied by biasing member 45 should be large, but should not be so large that the percussive hammer is unable to effect movement of driving surface 21 sufficient to overcome the biasing force. In one non-limiting embodiment, biasing member 45 is a compression spring, and the spring can engage end 37 of impact pin 23 to thereby pull impact pin 23 into a retracted position with at least a majority of impact pin 23 within the outer sleeve 3. In this preferred embodiment, when driving surface 21 forces impact pin 23 outward, the spring compresses. When the force from driving surface 21 is then removed from impact pin 23 such as by slidable movement of inner piston assembly 13, the spring can undergo its natural expansion, thereby causing impact pin 23 to retract into outer sleeve 3.

Inner piston assembly 13 of rock breaker device 1 can be composed of any number of driving surfaces 21 and impact pins 23. Of course, the more driving surfaces 21 that are used, the longer the inner piston assembly 13 becomes. In certain operations, a short rock breaker device 1 may be needed and, therefore, the inner piston assembly 13 may be comprised of only one or two driving surfaces 21 and associated impact pins 23. However, in other operations four, five, or more driving surfaces 21 and impact pins 23 may be desired. The outer sleeve 3 may also be reduced in length or extended based on the length of the inner piston assembly 13. This ability to customize the length of the rock breaker device 1 is another advantage of this invention.

In certain embodiments, the collection of driving surfaces 21 and impact pins 23 can be arranged so that the impact pins 23, or certain combinations of impact pins 23, are configured to strike in a synchronized fashion, meaning that the impact pins 23 strike at substantially the same time. However, in other embodiments, the driving surfaces 21 and impact pins 23 can be arranged so that the impact pins 23 strike in a staged manner, meaning that less than all of the impact pins 23 strike at the same time. For example, driving surfaces 21 and impact pins 23 can be arranged so that the impact pins 23 strike in sequence, focusing all of the energy on a single impact pin 23 at any one time. In this sequence striking arrangement, after the first impact pin 23 has struck the rock face, the second impact pin 23 can strike the rock face, and so forth. Modifying the order or timing in which the impact pins 23 strike can be accomplished by adapting the spacing of the driving surfaces 21 relative to one another, adapting the shape of the driving surfaces 21, and/or adapting the shape or length of the impact pins 23. The ability to modify the striking order and timing of the impact pins 23 is yet another advantage of this invention.

Rock breaker device 1 may also include a shield member 47 disposed near the connection point with the percussive hammer. When rock breaker device 1 is inserted into a borehole, shield member 47 surrounds the top of the borehole and forms a barrier which protects against debris that may fly from the borehole during the breaking operation. Shield member 47 also prevents objects from falling into the borehole and likewise prevents persons from inserting arms or hands into the borehole. Shield member 47 can include an indicia providing information about the direction of the impact pins 23, and shield member 47 can be used to rotate the rock breaker device 1 so that impact pins 23 are properly aligned (as explained below).

Rock breaker device 1 of the present invention can be rotated by as much as 360° to enable the user to aim the impact pins 23 in any direction. To this end, the rock breaker device 1 should include an indicia disposed at some point that is visible when the rock breaker device 1 is inserted in a borehole, such as on the shield member 47, to indicate the direction of the impact pins 23. The ability to aim the impact pins 23 in the desired direction to break or split rock is unique to this invention and extremely useful for several reasons.

First, many geologies contain rock which is laminated. Metamorphic rock is typically extremely laminated and most often the lamination is vertical as a result of the rock being thrust upwards from the earth. Some rock will more easily break/split when force is applied against the grain/lamination, while other rock formations will more easily break/split when the force is applied with the grain/lamination. This invention allows the user to either break with or against the grain, as desired, by simply rotating the rock breaker device 1 in the direction easiest to break/split the surrounding rock.

Secondly, the ability to rotate the device in any direction, combined with the benefit of focusing and concentrating energy to small impact pins 23 that may be located on just one side of the device, will enable the user to reduce, or even eliminate, the force that is applied in certain directions within the borehole so as not to disturb, for example, buried utility lines or structures.

Also provided is a method of breaking rock from within a predrilled borehole. The method uses the rock breaker device 1 described herein. The method includes positioning or inserting the rock breaker device 1 within a borehole and, when the rock breaker device 1 is in place, activating the associated percussive hammer to cause the impact pins 23 to repeatedly strike the inside of the borehole, and thereby transfer force from the hammer to the inside surface of the borehole. The method may also include rotating the rock breaker device 1 to align the impact pins 23 with a certain section of the borehole.

An assembly for breaking rock is also provided. The assembly includes a percussive hammer, such as those discussed elsewhere in this application and known in the art, connected to and engaging the rock breaker device 1 described herein. Such an assembly can be supported by and operated from an excavator, such as a front end loader. The assembly can be used to weaken and break apart rock from inside of a borehole by transferring the percussive force from the hammer to the inside sidewall surface of the borehole through the use of the inner piston assembly 13, driving surface 21, and impact pins 23 discussed herein.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

What is claimed is:

1. A device used to break rock from within a predrilled borehole, comprising:
- a sleeve;
- an inner piston assembly slidably housed within the sleeve and configured for engagement with a percussive hammer, the inner piston assembly comprising at least one driving surface, wherein the inner piston assembly is slidable in a longitudinal direction of the sleeve; and
- at least one impact pin in communication with the driving surface and extendable from a sidewall of the sleeve,
- wherein movement of the inner piston assembly in the longitudinal direction of the sleeve causes the impact pin to strike a sidewall of the predrilled borehole.

2. The device of claim 1, wherein the device comprises a plurality of impact pins.

3. The device of claim 2, wherein the device comprises a plurality of driving surfaces.

4. The device of claim 3, wherein each impact pin is in communication with a respective driving surface.

5. The device of claim 1, wherein the impact pin is in contact with the driving surface.

6. The device of claim 1, wherein the driving surface is a wedge or cone.

7. The device of claim 1, wherein the impact pin comprises a biasing member to bias the impact pin in a retracted position.

8. The device of claim 7, wherein the biasing member is a compression spring.

9. A method of breaking rock from within a predrilled borehole, comprising:
- positioning in the borehole a device comprising:
  - a sleeve,
  - an inner piston assembly slidably housed within the sleeve and comprising at least one driving surface, wherein the inner piston assembly is slidable in a longitudinal direction of the sleeve, and
  - at least one impact pin in communication with the driving surface and extendable from a sidewall of the sleeve,
  - wherein the device is connected to a percussive hammer; and
- activating the percussive hammer,
- wherein activating the percussive hammer causes movement of the inner piston assembly in the longitudinal direction of the sleeve, causing the at least one impact pin to repeatedly strike a sidewall of the predrilled borehole.

10. The method of claim 9, further comprising:
- rotating the device to align the impact pins with a desired section of the borehole.

11. An assembly used to break rock from within a predrilled borehole, comprising:
- a percussive hammer; and
- a rock breaker device attached to the percussive hammer,
- wherein the rock breaker device comprises:
- a sleeve;
- an inner piston assembly slidably housed within the sleeve and engaged with the percussive hammer, the inner piston assembly comprising at least one driving surface, wherein the inner piston assembly is slidable in a longitudinal direction of the sleeve; and
- at least one impact pin in communication with the driving surface and extendable from a sidewall of the sleeve, wherein movement of the inner piston assembly in the longitudinal direction of the sleeve causes the impact pin to strike a sidewall of the predrilled borehole.

12. The assembly of claim 11, wherein the percussive hammer is driven by hydraulic or pneumatic force.

13. The assembly of claim 11, wherein the percussive hammer is capable of delivering at least 200 impacts per minute.

14. The assembly of claim 11, wherein the rock breaker device comprises a plurality of impact pins.

15. The assembly of claim 14, wherein the rock breaker device comprises a plurality of driving surfaces.

16. The assembly of claim 15, wherein each impact pin is in communication with a respective driving surface.

17. The assembly of claim 11, wherein the impact pin is in contact with the driving surface.

18. The assembly of claim 11, wherein the impact pin comprises a biasing member to bias the impact pin in a retracted position.

19. The assembly of claim 18, wherein the biasing member is a compression spring.

* * * * *